US005702176A

United States Patent [19]

Engle

[11] Patent Number: 5,702,176

[45] Date of Patent: Dec. 30, 1997

[54] MODULAR CONNECTOR DEVICE

[75] Inventor: Joseph D. Engle, Naperville, Ill.

[73] Assignee: JJI Lighting Group, Inc., Greenwich, Conn.

[21] Appl. No.: 607,170

[22] Filed: Feb. 26, 1996

Related U.S. Application Data

[63] Continuation-in-part of Ser. No. 516,208, Aug. 17, 1995, which is a continuation of Ser. No. 353,902, Dec. 12, 1994, abandoned.

[51] Int. Cl.[6] ..... F21S 3/14

[52] U.S. Cl. ..... 362/219; 362/221; 362/225; 362/457

[58] Field of Search ..... 439/226, 228, 439/235, 237, 242; 362/219, 221, 225, 226, 260, 457

[56] References Cited

U.S. PATENT DOCUMENTS

| | | | |
|---|---|---|---|
| 2,988,633 | 6/1961 | Rosenfield | 362/219 |
| 3,524,050 | 8/1970 | Gustine | 362/219 |
| 4,001,571 | 1/1977 | Martin | 362/221 |
| 4,866,583 | 9/1989 | Targetti | 362/225 |
| 5,436,816 | 7/1995 | Nagano | 362/225 |
| 5,493,482 | 2/1996 | Bowen | 362/219 |
| 5,521,805 | 5/1996 | Lim | 439/235 |

*Primary Examiner*—Alan Cariaso
*Attorney, Agent, or Firm*—Fitzpatrick, Cella, Harper & Scinto

[57] ABSTRACT

A device for electrically connecting two modular light units respectively having free ends which include male and female double insulated connector plug means for electrically connecting the units together. The device includes an electrical cable having closed ends, male and female double insulated plug means respectively mounted on the opposite ends of the cable with the connector having a connector portion, a body portion rearward of the connector portion and being mounted on the cable end. The connector plug body includes a pair of laterally extending arms rearward of the connector portion. A removable cover is associated with each of the ends of the modular light units and at least two of the covers are associated with each of the connector plates. Those covers have removable knockout portions formed therein configured to define an opening in the cover generally complementary to the periphery of the body of the connector plug for receiving the body. The body is removably secured to its associated cover.

8 Claims, 4 Drawing Sheets

MODULAR CONNECTOR DEVICE

This application is a continuation-in-part of application No. 08/516,208, filed Aug. 17, 1995, which is a continuation of application No. 08/353,902, filed Dec. 12, 1994 abandoned.

FIELD OF THE INVENTION

The present invention relates to modular light units and more particularly to a so-called under cabinet light system in which a plurality of individual light modules are adapted to be connected to each other through double insulated electrical plugs mounted in their ends.

BACKGROUND OF THE INVENTION

Under cabinet lighting has previously been provided by a variety of manufacturers. Such lighting units typically consist of relatively thin fixtures hard-wired together and to a source of electrical current. Prior application No. 08/516,208, filed Aug. 17, 1995, discloses an improved modular light unit which allows under cabinet light fixtures to be electrically connected directly to each other through male and female double insulated electrical plug means having fully isolated terminals therein to eliminate the need for hard wiring connections or exposed electrical contacts.

An object of the present invention is to provide a connector or adaptor which permits the modular light units to be spaced from and positioned at angles with respect to one another while retaining the modular plug-in concept and eliminating the need for hard wiring.

Another object of the invention is to provide a modular lighting system and connector arrangement which is simple in construction and which can be easily installed by unskilled workers.

Yet another object of the present invention is to provide a lighting system in which a plurality of light modules can be connected together safely in end-to-end relationship and spaced from one another in order to provide variations in the overall lighting arrangement.

A still further object of the present invention is to provide a modular under cabinet lighting system and connection arrangement which is relatively simple to manufacture, service and install.

SUMMARY OF THE INVENTION

A connector device for electrically connecting at least two modular light units having free ends, respectively, including male and female double insulated electrical connector plugs for electrically connecting the units directly together is disclosed. The connector device comprises an electrical cable having opposed ends and male and female double insulated electrical connector plug means respectively mounted on the opposed ends of the cable for connecting the light fixtures together in spaced relation to each other. The connector plug means on the cable each have a connector portion and a body portion rearward of the connector portion mounted on the cable, with a pair of opposed laterally extending arms formed on the body portion rearward of the connector portion. Removable covers are provided for the ends of the modular light units which include means for removably connecting the covers to the housing. The covers have knockout portions removably secured therein which are configured to define an opening in the cover for receiving a body portion of the connector plug means on the cable. Means are provided on the plug means for removably securing the arms of the plug means to the cover.

The above and other objects, features and advantages of this invention will be apparent from the following detailed description of an illustrative embodiment thereof, which description is to be read in connection with the accompanying drawings wherein:

DESCRIPTION OF THE PREFERRED EMBODIMENTS

Figure 1:
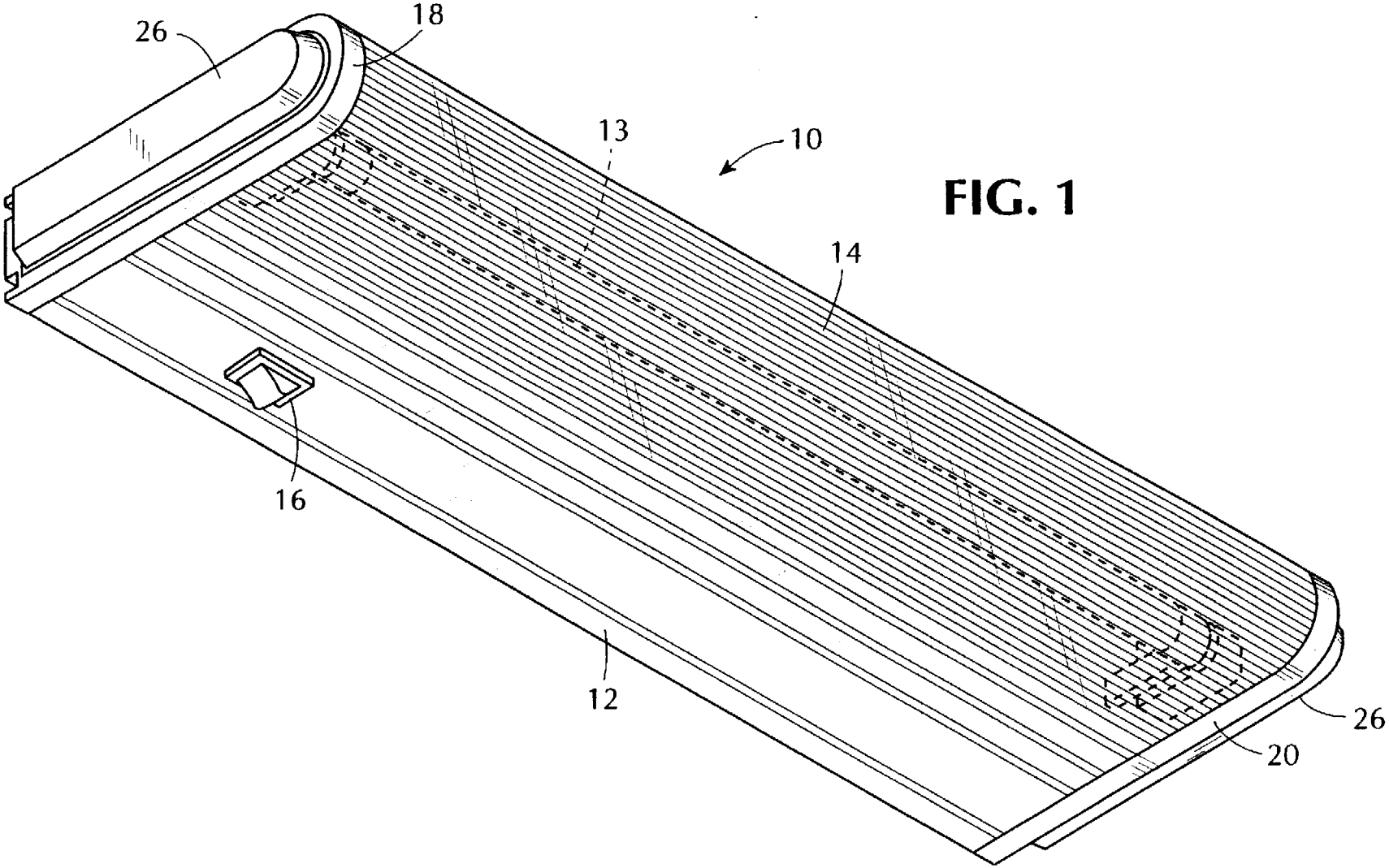
FIG. 1 is a perspective view of a modular light unit with which the connector device of the present invention is to be used.

Referring now to the drawings in detail, and initially to FIG. 1, a modular light unit 10 constructed in the manner described in the above-identified U.S. Pat. application No., filed Aug. 17, 1995, is illustrated. The disclosure of said application is incorporated herein by reference. The light fixture 10 includes a housing 12 which is generally L-shaped in cross section and contains one or more electrical lamps or bulbs 13 in a portion of the housing which is enclosed by a transparent cover 14. The light unit includes an on/off switch 16 for controlling current in the electrical wires within the housing to the bulb 13. The opposed ends of light unit 10 are closed by end caps 18, 20 which are preferably formed of an electrically insulating material such as Lexan®. The end caps provide mounting openings for double insulated electrical connector members which have fully isolated terminals. The end caps mount the connectors in a predetermined relationship so that two or more modules can be electrically interconnected by Simply sliding the ends of the units together. End cap 18 has a male connector 22 and end cap 20 has a female connector 24 (see FIG. 2) mounted therein as described in said above-identified application. When a particular end of the light unit is not connected to another light unit, its associated end cap is closed by removable covers 26.

Connectors 22, 24 are of known construction and are sold by the Molex Company under the trade name MINIFIT-BMI (for blind mating interconnect). These modular connectors have been sold in the past for high current/high density applications requiring blind mating of modules, sub-assemblies or printed circuit boards. They provide blind mating of wire-to-wire and have fully isolated terminals. This means that the terminals have their electrical connectors fully enclosed and not exposed to contact by the user.

In certain applications, it is required to connect two spaced apart light modules 10 while maintaining the ease of connecting units by the Molex connector as opposed to hard wire.

Figure 2:
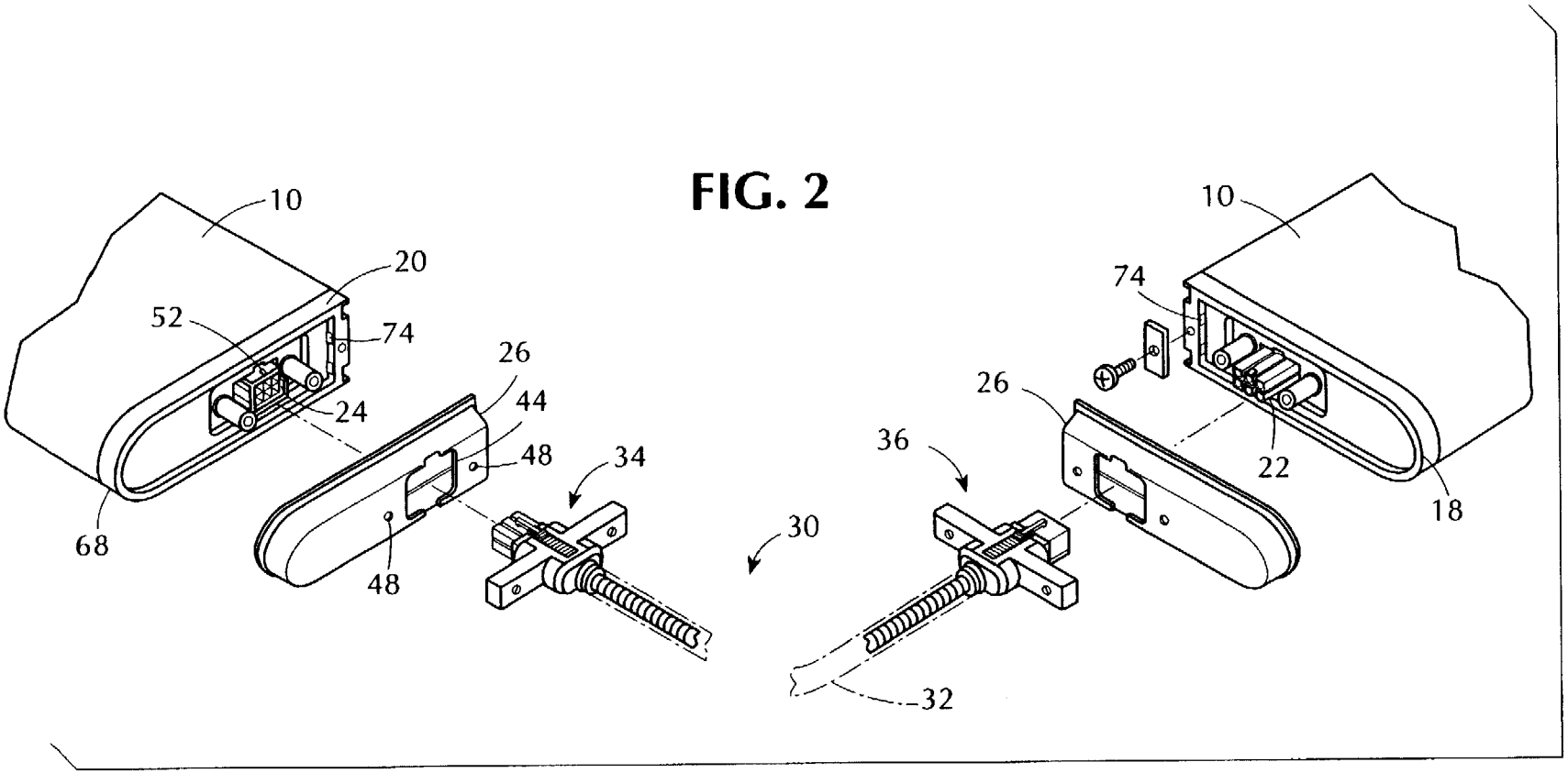
FIG. 2 is an exploded perspective view showing the connector device of the present invention connecting two modular light units.
Figure 8:
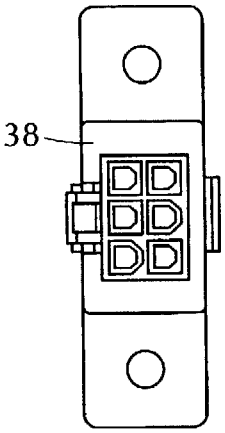
FIG. 8 is a front end view Of the plug shown in FIG. 6.
Figure 6:
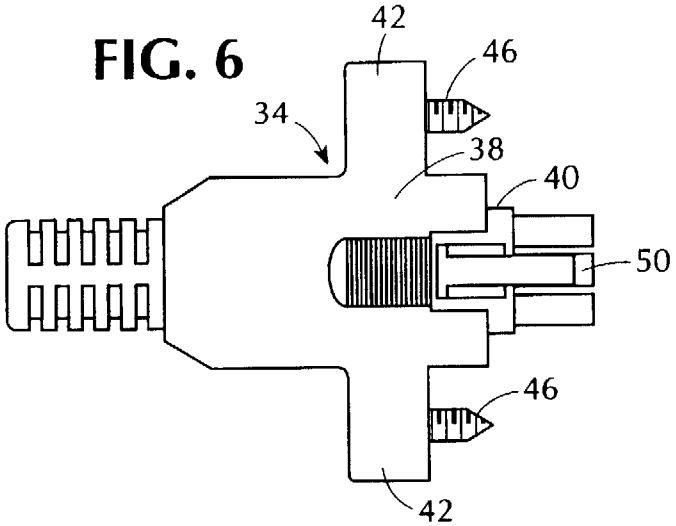
FIG. 6 is a top plan view of the male connector plug used in the connector device of the present invention.
Figure 11:
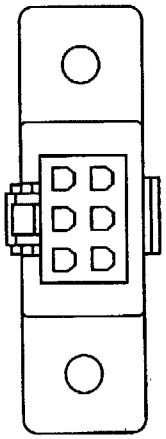
FIG. 11 is a front end view of the plug of FIG. 10.

In accordance with the present invention, as illustrated in FIG. 2, a connector device 30 is provided to accomplish this purpose. The device 30 includes an electrical cable 32 having connector plugs 34, 36 mounted on its ends. The connector plugs are shown in greater detail in FIGS. 6 through 11. Connector plug 34, as seen in FIGS. 6 through 9, includes a main body portion 38 having a male Molex connector 40 mounted therein. The Molex connector is electrically connected to the wires in the cable 32 in any convenient manner. The body 38 includes a pair of arms 42 extending laterally therefrom. The periphery of body 38 has a generally square shape, as seen in FIG. 8, and is adapted to be received in an opening 44 formed in cover 26 as described hereinafter. A pair of self-tapping screws 46 are provided in arms 42 which are adapted to be threaded into and engaged in screw holes 48 in cover 26 as described hereinafter.

Figure 7:
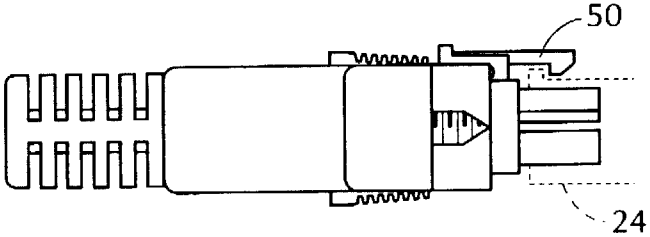
FIG. 7 is a side view of the plug shown in FIG. 6.

The body 38 also has a snap lever or finger 50 formed thereon, as seen in FIG. 7. This snap finger is adapted to snap over a tooth 52 formed on the body of the connector 24 in the light unit to form a firm mate therebetween, as shown in dotted lines in FIG. 7.

Figure 10:
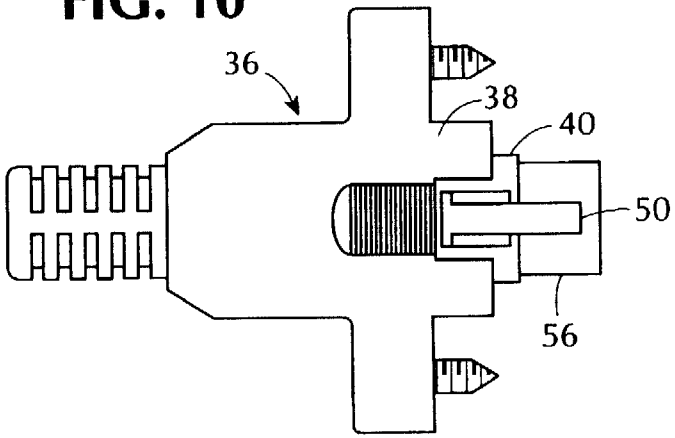
FIG. 10 is a top plan view similar to FIG. 6 of the female connector plug of the present invention.

The connector 36 shown in FIG. 10 is similarly constructed, with like reference numerals identifying like parts. The difference is that in connector 36 a female Molex connector 56 is provided for mating with male Molex connector 22 in a known manner. Here, again, body 38 has a snap finger 50 for connecting the plug to the Molex connector in the light fixture.

Figure 3:
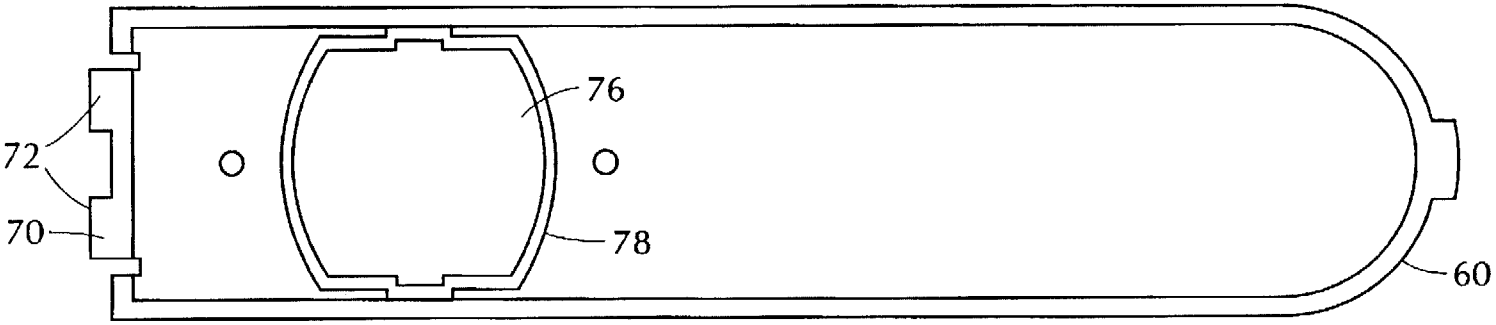
FIG. 3 is an interior elevational view of the cover used with the present invention.
Figure 4:
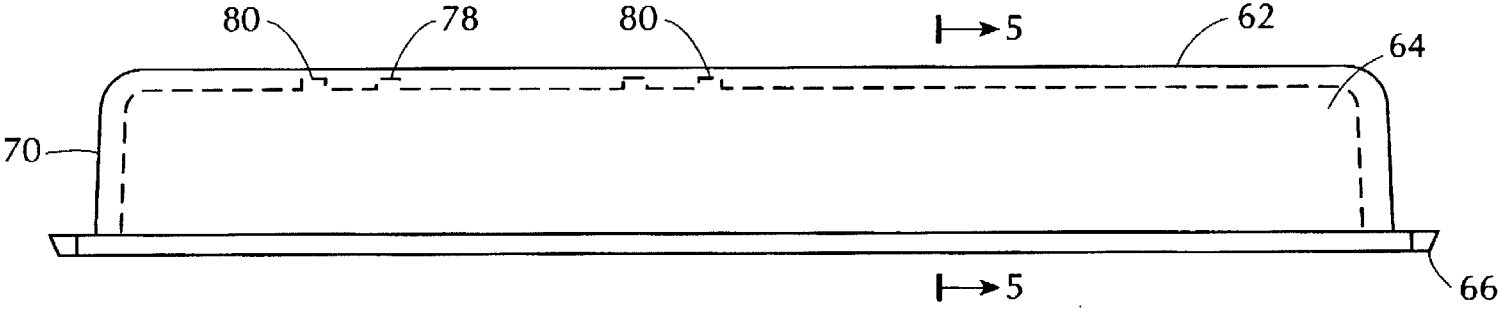
FIG. 4 is a top plan view of the cover.
Figure 5:
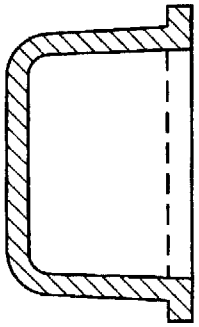
FIG. 5 is a sectional view taken along line 5—5 of FIG. 4.
Figure 9:
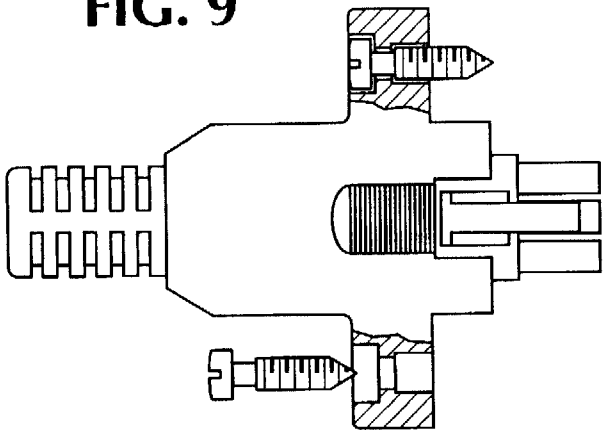
FIG. 9 is a top plan view similar to FIG. 6 but with parts broken away.

The cover 26 used in accordance with the present invention is shown in FIGS. 3–5. The cover has the same general construction as the cover described in application Ser. No. 08/516,208. It has a peripheral flange 60 and a recessed body portion 62 defining a chamber 64 which encloses the Molex connector on caps 20, 18 when the cover is mounted in place. To accomplish this the cover has a finger tab 66 at one end which is received in a recess 68 formed in the rounded end of the cap 20 (as shown in dotted lines in FIG. 2) and a resilient tab 70 at its opposite end having fingers 72 which are received in recesses 74 formed in the internal edge of the cap 20, again as shown in FIG. 2. By depressing resilient finger 70, the cover can be removed from the cap.

In accordance with the present invention, cap 26 has a knockout 76 formed therein which has the general shape of the periphery of the plug body 38. The knockout is integrally formed with the plastic or Lexan® cover. It is defined by a peripheral groove 78 of thinner dimensions than the balance of the cover. This allows knockout 76 to be removed by the installer using a simple screwdriver or the like to break the thin plastic remaining adjacent groove 78. By this arrangement, all covers provided with a lighting unit have the same construction and the installer simply removes the knockout as appropriate when required to use a connecting device 32 based on a particular installation.

The cover also includes recesses 80 formed therein which are thinner round sections of the cover adapted to receive the self-tapping screws 46. It is not necessary to remove the plastic at the recesses 80 during the installation process. The recesses 80 are formed to align with the location of the screws 46 on the plug so that when the screws are turned they will self-tap into the plastic.

By this invention, a relatively simple connecting arrangement is provided which makes a secure connection between the Molex connector while allowing the modular light unit to have a degree of flexibility of installation. The arrangement meets all UL requirements for drop testing, and the like, and provides a secure electrical connection.

Although an embodiment of the present invention has been described herein, it is to be understood that the invention is not limited to that precise embodiment, and that various changes and modifications may be affected therein by those skilled in the art without departing from the scope or spirit of this invention.

What is claimed is:

1. A connector device for electrically connecting at least two modular light units respectively having free ends including male and female double insulated electrical connector plug means mounted therein for electrically connecting said units directly together, said connector device comprising an electrical cable having opposed ends, male and female double insulated electrical connector plug means respectively mounted on the opposed ends of the cable, said connector plug means on the cable each having a connector portion, a body portion rearward of the connector portion and mounted on the cable end, and a pair of opposed laterally extending arms formed on the body portion rearward of said connector portion, a removable cover for the ends of said modular light units, including means for removably connecting the covers to the modular light units and said covers having knockout portions removably secured in the covers, said knockout portions being configured to define an opening in said cover for receiving one of the plug means on said cable, and means for removably securing the arms of the plug means to said cover.

2. A connector as defined in claim 1, wherein said means for securing the arms of the plug means to the cover comprise at least one self-tapping screw in said arm of the plug means.

3. A connector device as defined in claim 1, wherein said removable cover includes means for snap fitting the cover on the ends of said modular light unit.

4. A device for electrically connecting two modular light units respectively having free ends which include male and female double insulated electrical connector plug means for electrically connecting said units together; said device comprising an electrical cable having opposed ends, male and female double insulated electrical plug means respectively mounted on the opposed ends of the cable, said connector plug means on the cable each having a connector portion, a body portion rearward of the connector portion and mounted on the cable end, and a pair of laterally extending arms formed on the body portion rearward of said connector portion, a removable cover associated with each of the ends of the modular light units, at least two of said covers being associated with each of said connector plug means and having removable knockout portions formed therein configured to define an opening in the cover generally complementary to the periphery of the body of the connector plug means for receiving said body, and means for removably securing the body of said connector plug means to its associated cover.

5. A device as defined in claim 4, wherein said securing means includes snap means on said body portion for releasably engaging the periphery of the opening in its associated cover.

6. A device as defined in claim 5, wherein said securing means includes means for securing the arms of said connector plug means to said cover.

7. A connector as defined in claim 6, wherein said means for securing the arms of the plug means to the cover comprise at least one self-tapping screw in said arm of the plug means.

8. A connector device as defined in claim 7, wherein said removable cover includes means for snap fitting the cover on the ends of said modular light unit.

* * * * *